US009421140B2

(12) United States Patent
Faucher et al.

(10) Patent No.: US 9,421,140 B2
(45) Date of Patent: Aug. 23, 2016

(54) PATIENT/INVALID LIFT WITH SUPPORT LINE BEARING POWER AND DATA COMMUNICATIONS

(75) Inventors: Martin Faucher, Quebec (CA); Denis-Alexandre Brulotte, Quebec (CA)

(73) Assignee: ARJOHUNTLEIGH MAGOG INC., Magog, New Brunswick (CA)

( * ) Notice: Subject to any disclaimer, the term of this patent is extended or adjusted under 35 U.S.C. 154(b) by 1040 days.

(21) Appl. No.: 13/552,041

(22) Filed: Jul. 18, 2012

(65) Prior Publication Data

US 2013/0019401 A1 Jan. 24, 2013

Related U.S. Application Data

(60) Provisional application No. 61/509,177, filed on Jul. 19, 2011.

(51) Int. Cl.
*A61G 7/10* (2006.01)
*A61G 7/14* (2006.01)

(52) U.S. Cl.
CPC ..... *A61G 7/1015* (2013.01); *A61G 7/1051* (2013.01); *A61G 7/1061* (2013.01); *A61G 7/108* (2013.01); *A61G 7/1042* (2013.01); *A61G 7/1078* (2013.01); *A61G 2200/34* (2013.01); *A61G 2203/20* (2013.01); *A61G 2203/44* (2013.01)

(58) Field of Classification Search
CPC ..... A61G 7/1015
USPC ..... 5/83.1, 85.1, 87.1, 88.1, 89.1; 254/270, 254/273, 275
See application file for complete search history.

(56) References Cited

U.S. PATENT DOCUMENTS

| | | | | |
|---|---|---|---|---|
| 5,325,457 | A | 6/1994 | Bottoms, Jr. et al. | 385/113 |
| 5,456,655 | A * | 10/1995 | Morris | 601/23 |
| 5,511,256 | A * | 4/1996 | Capaldi | A61G 7/1015 403/217 |
| 5,809,591 | A * | 9/1998 | Capaldi et al. | 5/83.1 |
| 5,917,977 | A | 6/1999 | Barrett | 385/101 |
| 5,939,857 | A * | 8/1999 | Madigan | H02J 7/0027 320/107 |
| 8,397,320 | B2 * | 3/2013 | Capaldi | A61G 7/1015 5/83.1 |
| 8,701,226 | B2 * | 4/2014 | Faucher et al. | 5/85.1 |
| 8,978,905 | B2 * | 3/2015 | Bergenstråle | A61G 7/1042 212/324 |
| 2005/0201696 | A1 | 9/2005 | Fee | 385/101 |
| 2010/0158457 | A1 | 6/2010 | Drozd et al. | 385/113 |
| 2011/0000015 | A1 * | 1/2011 | Faucher | B66C 7/08 5/83.1 |
| 2012/0000876 | A1 * | 1/2012 | Bergenstrale | A61G 7/1042 212/336 |
| 2012/0159706 | A1 * | 6/2012 | Capaldi | A61G 7/1015 5/85.1 |
| 2013/0019401 | A1 * | 1/2013 | Faucher | A61G 7/1015 5/85.1 |
| 2014/0115778 | A1 * | 5/2014 | Ng | 5/83.1 |

FOREIGN PATENT DOCUMENTS

| | | | |
|---|---|---|---|
| WO | WO 03/037239 | A1 | 5/2003 |
| WO | WO 2009/104096 | A2 | 8/2009 |

OTHER PUBLICATIONS

International Search Report and Written Opinion for corresponding PCT/IB2012/001399 mailed Dec. 13, 2012 (8 pages).

* cited by examiner

*Primary Examiner* — Robert G Santos

(57) ABSTRACT

A patient lift for transporting patients having a hoist assembly, a lift assembly and an integrated flexible load-bearing supporting member. The flexible load-bearing supporting member is retractable into the hoist assembly and has integrated load-bearing, data communications, and power components to transmit data and/or power to/from the hoist assembly and lift assembly.

19 Claims, 10 Drawing Sheets

PATIENT/INVALID LIFT WITH SUPPORT LINE BEARING POWER AND DATA COMMUNICATIONS

CROSS-REFERENCE TO RELATED APPLICATIONS

This application is a non-provisional application which claims priority to U.S. Provisional Application No. 61/509,177 filed on Jul. 19, 2011, which is incorporated by reference herein in its entirety.

TECHNICAL FIELD

This invention refers ceiling/elevated lift assemblies that are mounted to or on overhead tracks that permit the lift to travel along the track to various locations to lift or convey patients or equipment, and specifically to lift assemblies that require power and/or data communications to/from and between various components of the lift assembly.

BACKGROUND

Patient lifts are commonly used in hospitals and other care centers, as well as in the homes of those with mobility impairments, to convey people and/or equipment to different areas, for example from a bed to a bathroom or from a bed to a chair. Patient lifts permit the movement of the individual with far decreased effort on the part of the caregiver, all while helping to preserve the comfort and dignity of the immobile individual. Patient lifts can be used in hospitals, nursing facilities, hospices, and homes or any type of environment where healthcare services are provided and patient handling is needed.

One type of patient lift includes ceiling lifts. Ceiling lifts use ceiling hoist technology, which hoists the person from above using various forms of hoists. One form of such a ceiling lift is a lift that is able to travel on one or more tracks that are suspended from the ceiling or other elevated structure. These lifts include fixed ceiling lifts, where the track is affixed to the ceiling and lifting assembly is directly attached to the track, and portable ceiling lifts, where the lift assembly is removably attached to the ceiling track or a member attached to the ceiling track. Some examples of such lifts are shown in U.S. Pat. No. 7,237,491 to Faucher et al., U.S. Pat. No. 6,675,412 to Faucher et al., and U.S. Publication No. 2011/0000015 to Faucher et al., each incorporated by reference in its entirety herein. In the example shown in U.S. Publication No. 2011/0000015, the components of the assembly may communicate power and data between them, utilizing a control unit mounted on a wall or elsewhere, and it would be advantageous to provide a flexible load-bearing member between the patient-support portion and the ceiling track that would minimize the presence of extra wires and/or other external components that may clutter or otherwise impair desirable efficiency, functionality, and aesthetics.

The invention provides an improved patient lift for moving patients.

BRIEF SUMMARY

The present invention relates to patient lifts, which may be fixed or portable, for transporting patients or equipment, and which convey power and/or data communications from one component to another through a flexible load-supporting member where the power and data communications components are integrated with the a flexible load-supporting member. In the case of ceiling lifts utilizing tracks, power and/or data communications may be transmitted from and/or between a track assembly to a track trolley, and further to one or more additional components of the ceiling lift via the flexible load-bearing supporting member. The flexible load-bearing supporting member has integrated load-bearing, communications/signal and power and may be disposed between a hoist assembly attached to a track riding trolley and a lift assembly, or between the track riding trolley and the hoist assembly. The integrated flexible load-supporting member hence provides power and/or data to the various components of the ceiling lift system without the need for multiple wires and time consuming cable management.

BRIEF DESCRIPTION OF THE DRAWINGS

The invention will now be described by way of example only, with reference to the accompanying drawings in which.

DETAILED DESCRIPTION

Figure 1:
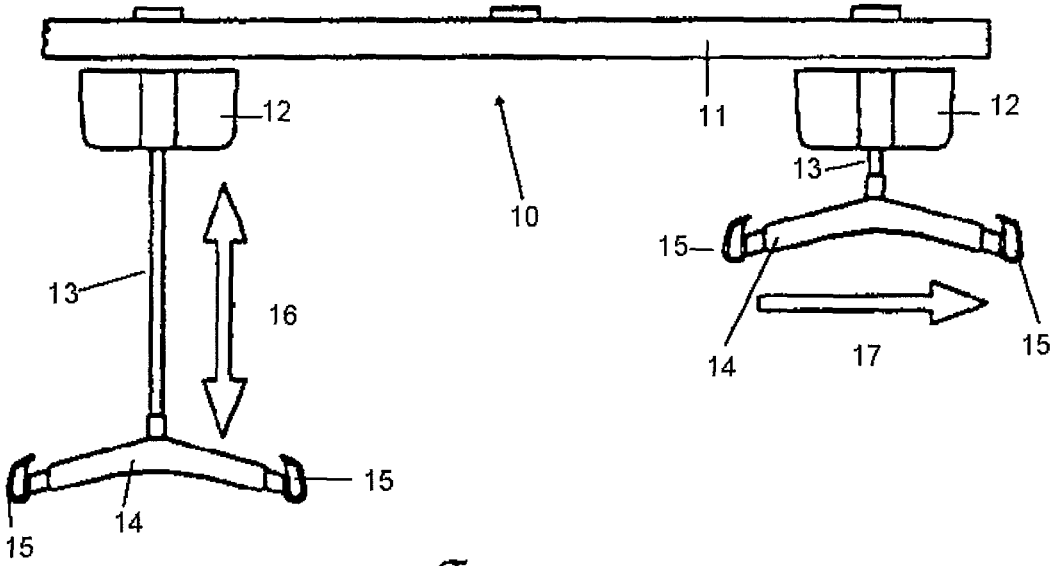
FIG. 1 is illustrative of a fixed ceiling lift.

The present invention relates to patient lifts, and in particular ceiling lifts that ride along one or more tracks. Specifically, the invention relates to ceiling lifts that convey power and/or data communications from one component to another without exposed power cords or communication data lines. More specifically, the invention relates to ceiling lifts that that convey power and/or data communications from one component to another through a flexible load-supporting member where the load bearing, power and data communications components are integrated with the flexible load-supporting member. These and other aspects are more fully described below with reference to the appended figures.

Ceiling lifts that utilize tracks generally comprise one or more tracks that are attached to or suspended from a ceiling or other elevated structure, a track trolley that is configured to ride along the track[s], a hoist assembly, a lift assembly, and a flexible load-supporting member.

The track (or tracks, if multiple tracks are used) may be attached directly to the ceiling or suspended from the ceiling or other elevated structure. The track(s) may be a profiled track that has a rolling surface for the track trolley. The track(s) may be straight, curved or any other desired configuration that facilities movement of a patient conveyance to a desired location. The track further may include both upper and lower tracks with the track trolley traveling along an upper track so that the hoist assembly can move in two dimensions (in both the direction of the upper track and the direction of the lower track). This configuration is illustrated in U.S. Patent Application No. 2011/0000015, FIG. 4 and described at paragraphs [0015], [0020]-[0023], which are incorporated by reference herein. A track assembly also may be an X-Y system having a primary rail and a transverse rail, such as that shown in U.S. Pat. No. 7,237,491 FIGS. 12-19 and described at column 19, lines 8-67 through column 20, lines 1-65, all incorporated by reference herein. The track may be made of any suitable material such as metal or rigid plastic. Alternatively, the track or tracks may be flexible or articulated so that they may be bendable and oriented as desired. For example, the track may be made of a semi-flexible plastic material. Further, the track assemblies may be fixed-track systems or moving track systems, such as that shown in FIG. 4 and described at paragraphs [0010] and [0020]-[0021] of United States Publication No. 2011/0000015, incorporated by reference herein.

The track preferably transmits power and/or communicates data to a track trolley. For example, an example of how the track may transmit power or data to a trolley is described in United States Publication No. 2011/0000015, which is incorporated in its entirety herein. Thus, a control unit, which is mounted on a wall or elsewhere, may communicate power and/or data to the trolley by way of the track.

The track trolley is attached to and moveable along the track. The track trolley is attached, directly or indirectly as described below, to the hoist assembly. The track trolley may comprise wheels that engage the track. Alternatively, the relationship between track and trolley may be frictional.

The hoist assembly, which raises and lowers the lift assembly, may have a winding unit or assembly for winding and unwinding the flexible load-supporting member. The hoist assembly is driven by a motor and transmission elements. The winding assembly may include a drum upon which the flexible load supporting member is wound.

The lift assembly, which is below the hoist assembly, includes or is configured to connect to, a patient support or conveyance. For example, the patient support or conveyance may be a sling, harness, basket or the like. The lift assembly may also include a lifting bar, spreader bar, or a mounting block for supporting the patient support or conveyance. The lift assembly and/or its components may be powered and also may generate, use and/or communicate data, by way of, for example, visual displays, sensors, sound emitting components, controls, and the like. For example, the lift assembly may include load cells for monitoring a patient's weight distribution in the conveyance, a visual display or aural communication of a patient's overall weight and weight distribution in the conveyance, an alarm of some nature that indicates an unsafe condition, an emergency stop for halting the raising or lowering of the lift assembly or the traveling of the trolley on the track. In one example, a lifting bar, spreader bar or mounting block may include load cells.

The flexible load-supporting member may be a strap, a cable, or the like. The flexible load-supporting member is load-bearing and includes integrated load-bearing, power and/or data communication lines, for example light transmitters, electrical power conductors, data or signal conductors, and the like, that transmit power and/or data along the length of the load-supporting member. In the preferred embodiment, the load bearing component(s), communications and power transmitting components are integral with the flexible load-supporting member. The flexible load-supporting member may be located between the hoist and the lift assembly or between the trolley and the hoist assembly, and preferably transmits power and/or communications between the hoist assembly and the lift assembly if configured in that manner, or between the trolley and the hoist assembly, if configured in that manner. The load-supporting member may be a strap, a cable or the like, and may be formed of webbing, mesh, braided cable, layered cable and the like, with the power and/or data lines defining strands or layers therein.

Figure 2:
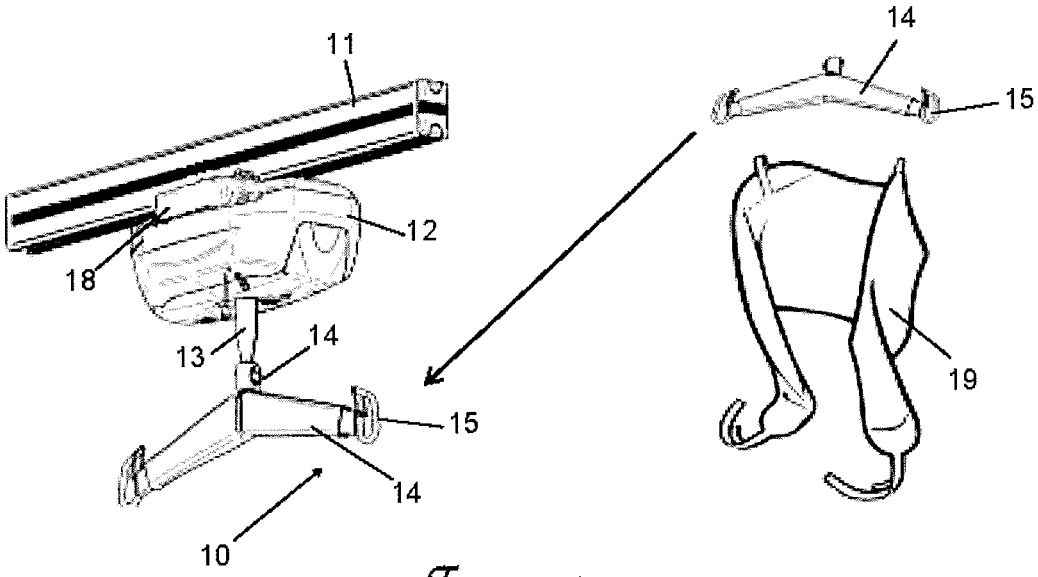
FIG. 2 is another illustration of a fixed ceiling lift with a patient support.
Figure 4:
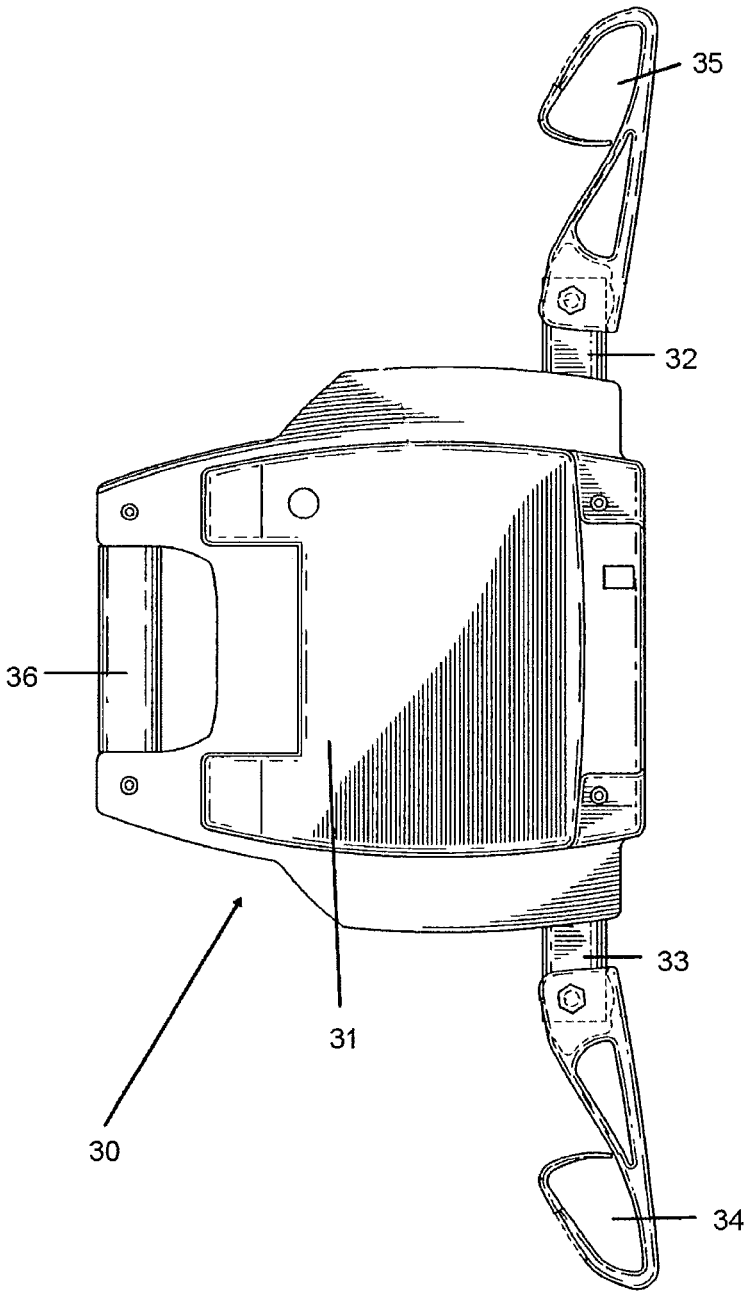
FIG. 4 shows an example of a portable ceiling lift.
Figure 5:
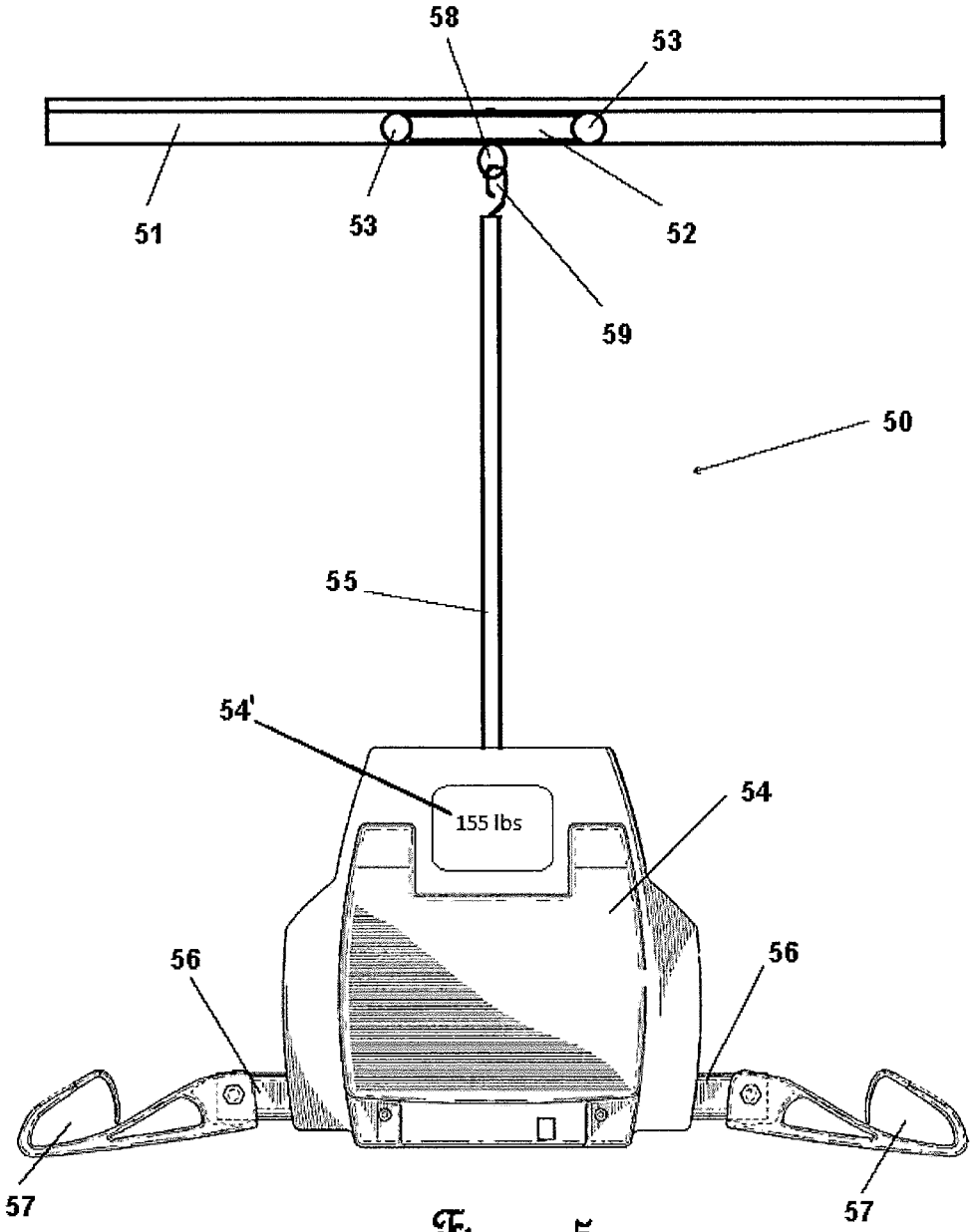
FIG. 5 illustrates a portable ceiling lift a flexible load-supporting member in an unwound or extended condition.

As set forth above, types of ceiling lifts include fixed ceiling lifts and portable ceiling lifts. Examples of a fixed ceiling lift are shown in FIGS. 1 and 2. Examples of portable ceiling lifts are depicted in FIGS. 4 and 5. With a portable ceiling lift, the ceiling lift may be removed from the track/track trolley for relocation elsewhere, maintenance and the like. One exemplary ceiling lift that may make use of the present invention is described in U.S. Pat. No. 6,675,412, which disclosure is incorporated by reference in its entirety herein.

FIG. 1 shows one non-limiting example of a fixed ceiling lift 10. Ceiling lift system 10 includes track 11, track trolley (not shown in FIG. 1), hoist assembly 12, a flexible load supporting member 13, and spreader bar 14 having attachment handles 15 or other means of attaching a patient support. As indicated by arrow 16, the spreader bar 14 may move in a vertical direction by retracting the flexible load supporting member 13 to, for example raise a patient from a bed, chair, gurney, or the like. As indicated by arrow 17, the hoist assembly with the flexible-load supporting member 13 and spreader bar 14 (and hence the patient conveyance) may be moved horizontally to move a patient from one location to another.

Although the track as shown is straight, the track may be curved, circular or some other configuration depending on the specific need. The combination of a track system, track trolley, hoist assembly, flexible load-supporting member, spreader bar or lifting bar, and a patient support or conveyance is referred to collectively here as a ceiling lift system. The combination of, a spreader or lifting bar, with or without a patient support or conveyance is referred to collectively here as a ceiling lift assembly. Although the present invention is described here with reference to the use of tracks, the present invention is also fully applicable to other elevated lift systems.

FIG. 2 also shows a fixed ceiling lift system 10 having a track 11, track trolley 18, hoist assembly 12, flexible load supporting member 13, spreader bar 14 and handles 15. Further shown is sling 19, which may be attached to handles 15 to provide a conveyance for a patient or equipment.

Figure 3:
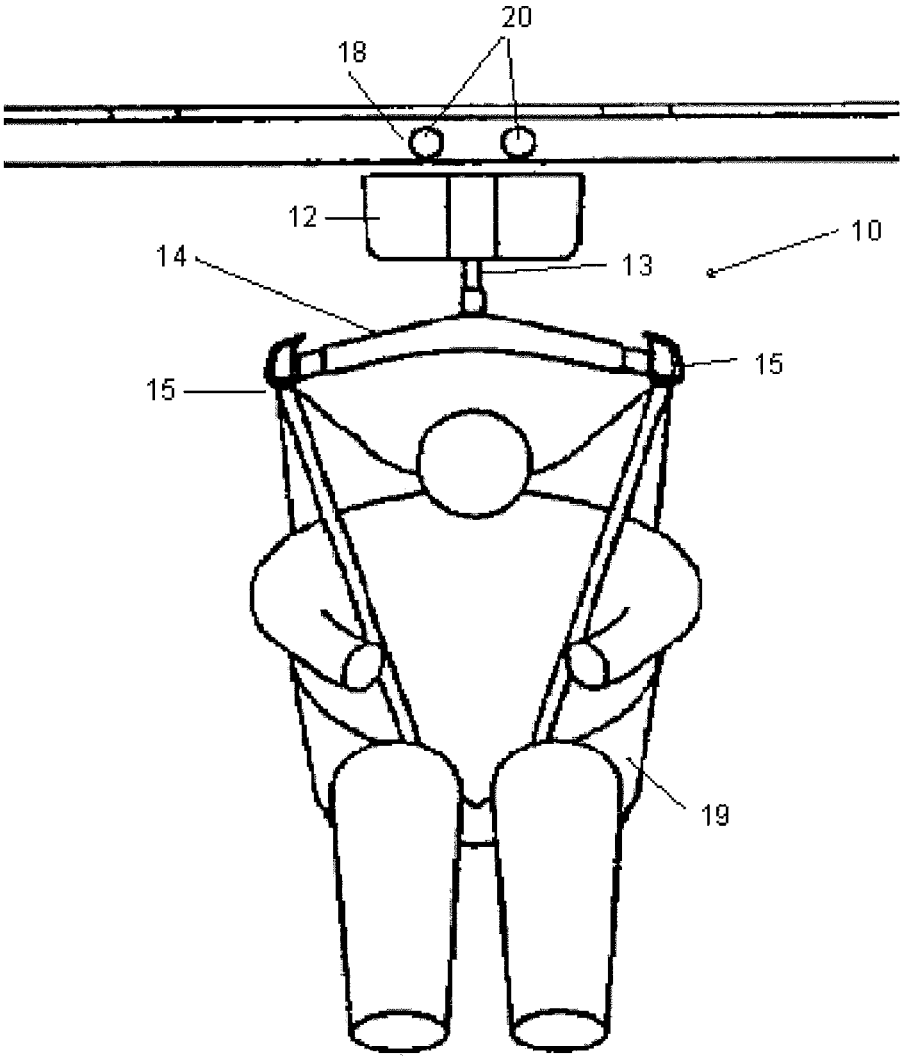
FIG. 3 is another illustration of a fixed ceiling lift with a patient in a patient support.

FIG. 3 shows an example of a fixed ceiling lift carrying a patient. As with above, the ceiling lift system 10 includes a track 11, hoist assembly 12, a flexible load supporting member 13, a spreader bar 14 having handles 15, track trolley 18, and sling 19. As shown, the hoist assembly 12 rides along the track via track trolley 18, which, in this figure has wheels 20.

FIG. 4 illustrates an exemplary portable ceiling lift. As shown, the portable ceiling lift 30 may include hoist assembly (or body winch) 31, support arms 32 and 33, carrying elements 34 and 35, and handle 36. The portable ceiling lift may be attached to a track assembly, for example by way of a flexible load supporting member as shown in FIG. 5. Suitable configurations for portable ceiling lifts are shown in FIGS. 1-9 of U.S. Pat. No. 6,675,412, which figures are incorporated by reference herein, and described at column 2, line 24 through column 7, line 15, all of which description is incorporated by reference herein FIG. 5 shows a portable ceiling lift system 50. As shown, track 51 is suspended from a ceiling or other structure. Track trolley 52 is engaged in the track 51 and may comprise wheels 53 for moving along the track 51. The portable ceiling lift 50 includes a hoist assembly 54, flexible load supporting member 55, arms 56, and hooks 57 for attachment to a patient sling or other conveyance. The track trolley 52 may include a trolley ring or hook 58, other suitable configuration for attaching to the flexible load supporting member 55. The flexible load supporting member 55 may include a corresponding hook or ring 59 for attaching to the trolley ring 58. In one example, either of the hooks may be a carabiner type attachment hook. As shown in FIG. 5, for example, the system 50 may include one or more displays 54'. In this particular example, the display 54' displays the patient's weight.

Figure 6:
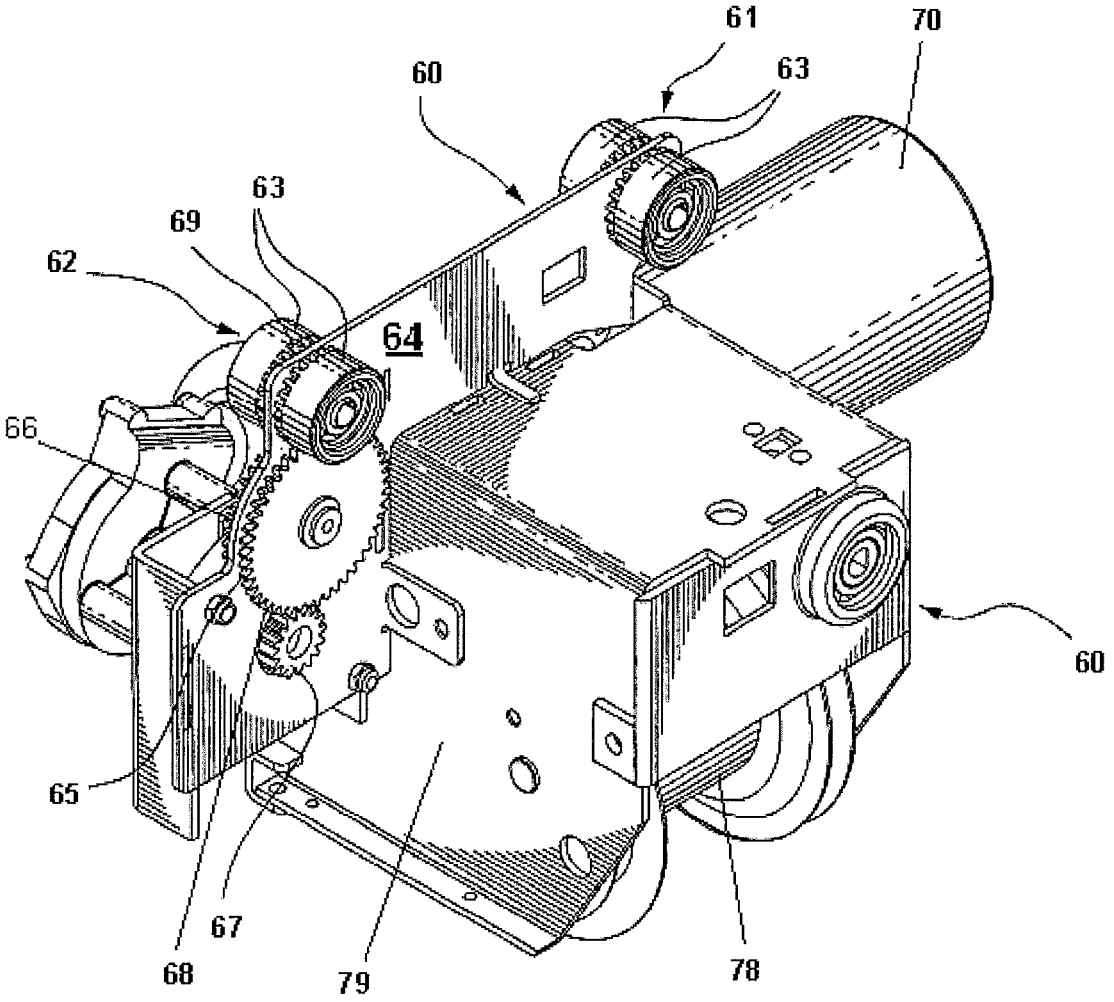
FIG. 6 shows an exemplary hoist assembly for a fixed ceiling lift.
Figure 7:
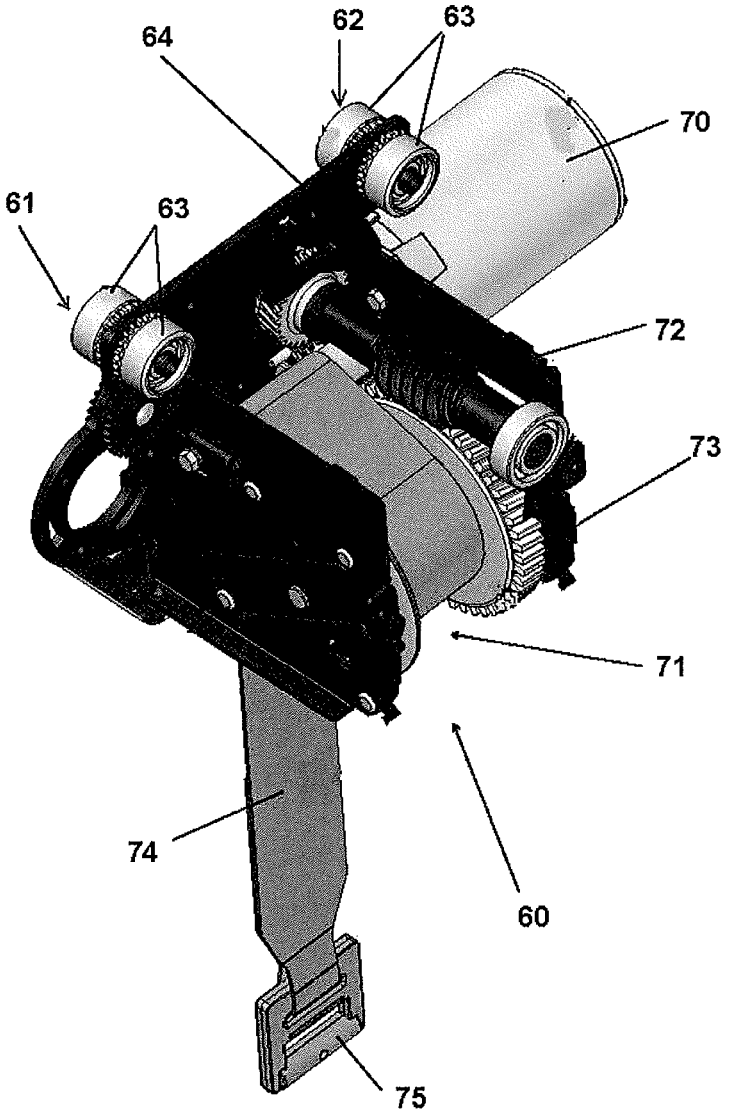
FIG. 7 shows an exemplary hoist assembly for a fixed ceiling lift with load-supporting member in at least a partially unwound or extended condition.

FIGS. 6-7 show various aspects of an exemplary hoist assembly. FIG. 6 shows a perspective view of a hoist assembly provided with a track trolley and a motor. FIG. 7 shows the same view as in FIG. 6 but with a housing piece removed to show various components including a winding drum. FIG. 6 illustrates a hoist assembly 60. As shown, the hoist assembly 60 includes two pairs 61 and 62 of opposed wheels 63. The wheels shown in FIG. 6 are lateral motion wheels, though the invention is not so limited. The wheels 63 are placed on opposite sides of central projection or web 64. The hoist assembly includes at least gears 65, 66 and 67, which may be two idler gears and a driver gear, respectively. Idler gears 65 and 66 may be provided with sprocket or gear teeth 68, which are sized and configured to mesh with corresponding engagement openings 69 on the periphery of the wheels 63. Alternatively, the engagement of the gears and the wheels may be frictional in nature. The hoist assembly 60 further includes motor 70, winding unit 71, transmission elements 72 and 73 (not shown in FIG. 6), frame elements 79, and winding drum 78 (partially shown).

The hoist assembly may include further elements such as those shown in FIGS. 5-10 of U.S. Pat. No. 7,237,491 and described at column 12, lines 5-52 (describing the figures), column 15, lines 31-65 through column 16, lines 1-6) (describing the various components of the assembly, column 16-17 (describing a structure for a coupling/decoupling component, structure for engaging or disengaging a clutch, structure for the process of engaging and disengaging a motor, such as a reversible motor), column 18, lines 60-67-column 19, lines 1-7, 48-65 (describing alternate clutch mechanisms).

FIG. 7 shows a perspective view of hoist assembly 60 with part of the housing removed. Hoist assembly 60 includes 60 includes two pairs 61 and 62 of opposed wheels 63. The wheels shown in FIG. 7 are lateral motion wheels like those shown in FIG. 6. The wheels are place on opposites of central projection or web 64. The hoist assembly includes gears 65 and 66. Gears 65 and 66 may be provided with sprocket or gear teeth 67 as shown, which are sized and configured to mesh with corresponding engagement openings 68 on the periphery of the wheels 63. Alternatively, the engagement of the gears and the wheels may be frictional in nature. The hoist assembly 60 further includes motor 70, winding unit 71, which may be a drum, transmission elements 72 and 73 (shown as gears), and flexible load-supporting member 74.

FIG. 7 shows the flexible load-supporting member 74 partially wound on winding unit 71. As shown, flexible load-supporting member 74 includes an attachment mechanism 75 for attachment to a lift assembly. The flexible load-supporting member 74 functions to support the load of a patient (or equipment), while in both the wound (coiled) and unwound (uncoiled or extended) positions with regard to the winding (coiling) unit 71. The winding and unwinding of the flexible load-supporting member 74 translates into the upward and downward movement of the patient. The flexible load-supporting member 74 may be formed of webbing, braided cable or the like.

In operation, the ceiling lift is positioned over a patient and the spreader bar is lowered to the patient by uncoiling the flexible load supporting member from the winding drum. The drum is rotated by means of the motor via the transmission elements in manners known to one of ordinary skill in the art. After placement of the patient in the patient support, such as a sling, basket, harness, or the like, the spreader bar is raised by winding the flexible load supporting member onto the drum to the appropriate height to permit movement of the patient. The ceiling lift laterally moved to a desired destination point. Upon reaching the destination point the spreader is lowered by unwinding the flexible load supporting member to lower the patient and complete the patient transfer.

The load supporting member may be located between the hoist assembly and the lift assembly. In one example, the hoist assembly and track trolley are in a fixed relationship with the trolley fixedly mounted atop the hoist assembly so that it may convey the hoist assembly along the track. In this configuration, the flexible load-supporting member is between the hoist assembly and the lift assembly descending from the hoist assembly to the lift assembly. The hoist assembly winds and unwinds the flexible load-supporting member to raise and lower the lift assembly.

In another embodiment, the flexible load-supporting member is between the trolley and the hoist assembly (as shown in FIG. 5). In this configuration, flexible load-supporting member extends from the trolley. The lift assembly extends from the hoist assembly and may be in a fixed relationship with the hoist assembly. In another embodiment, the lift assembly may be a separate component from the hoist assembly (for example, with a portable hoist assembly as discussed here). The hoist assembly winds and unwinds the flexible load-supporting member to raise and lower the hoist assembly along with the lift assembly.

As set forth above, the flexible load-supporting member includes power and/or data communication lines, for example light transmitters, electric conductors and the like, that transmit power and/or data along the length of the load-supporting member. In the present invention, the load bearing and power/communications components of the flexible load-supporting member are integrated into the flexible load-supporting member as described in more detail below. As used with regard to the flexible load-supporting member, the term "integrated" means that the load bearing components, the electrical components, and the communications components are formed within a single structure or otherwise within the flexible load-supporting member.

In the above described arrangements, the lift assembly and/or the hoist assembly may receive power and/or data communications that are transmitted along the track from a control unit or other remote location. In the first configuration described above, power and data communications may be transmitted from a control unit and along the track to the hoist assembly, then through the flexible load-supporting member to the lift assembly. In the second configuration described above, power and data communications may be transmitted from the control unit and along the track to the flexible load-supporting member to the hoist assembly and the lift assembly. In the case of a fixed ceiling lift, the flexible load-supporting member also may transmit power to and from the spreader bar, accessories, motion control means or other components that require power to operate. The flexible load-supporting member also may transmit data to and from the spreader bar or associated components, for example data to be displayed to the user on a display integrated with the spreader bar or associated with it.

Power and/or data may be communicated between the flexible-load supporting member and the lift assembly, in the arrangement where the flexible-load supporting member is between the hoist assembly and the lift assembly, or between the flexible-load supporting member and the track trolley, in the arrangement where the flexible-load supporting member is between the track trolley and the hoist assembly, in any manner known to one of skill in the art. As the flexible-load supporting member may be mounted in fixed relation to the track trolley or the lift assembly, the power and/or data leads within the flexible-load supporting member may be connected to corresponding leads in these components. Power and/or data may be communicated between the flexible-load supporting member and the hoist assembly using, for example, slip ring and brush arrangements, or other arrangements allowing reliable communications between stationary and rotary components. Suitable arrangements for use in the present invention may be found in one or more of U.S. Pat. Nos. 7,811,092; 7,001,184; 6,884,109; 6,7717,320; 6,517,357; 5,865,629; 5,775,922; 4,946,010; 4,232,922; 4,105,445; and 3,953,095, all incorporated by reference herein.

Suitable connectors or other components may be disposed between any adjacent two of the track trolley, the hoist assembly, the lift assembly and the flexible-load supporting member such that power and/or data communications may extend across these components. The track trolley may include a connector that permits removal of the flexible-load supporting member (along with the hoist and/or lift assembly) for replacement or movement to another ceiling track trolley. For example, the track trolley may include a connector with a female socket for receiving a terminal male connector disposed on the end of the flexible-load supporting member to establish power and/or data connections between the flexible-load supporting member (and its hoist and lift assemblies) and the track trolley (and its associated track(s) and control unit(s). In this arrangement the flexible-load supporting member, the hoist, and lift assembly may be removed from one track trolley in one location to another track trolley in another location. In another example, the other end of the flexible-load supporting member may have a terminal male connector or female socket for engaging a corresponding female socket or male connector on the lift assembly (see reference numeral 14' of FIG. 2), such as on the spreader bar, permitting removal of the lift assembly while leaving the flexible-load supporting member in place. In yet a further example, both ends of the flexible-load supporting member may include a connector such that the member may be removed for use elsewhere and/or different flexible-load supporting members (e.g., having different lengths, weight capacities, etc.) may be used/interchanged.

Figure 8:
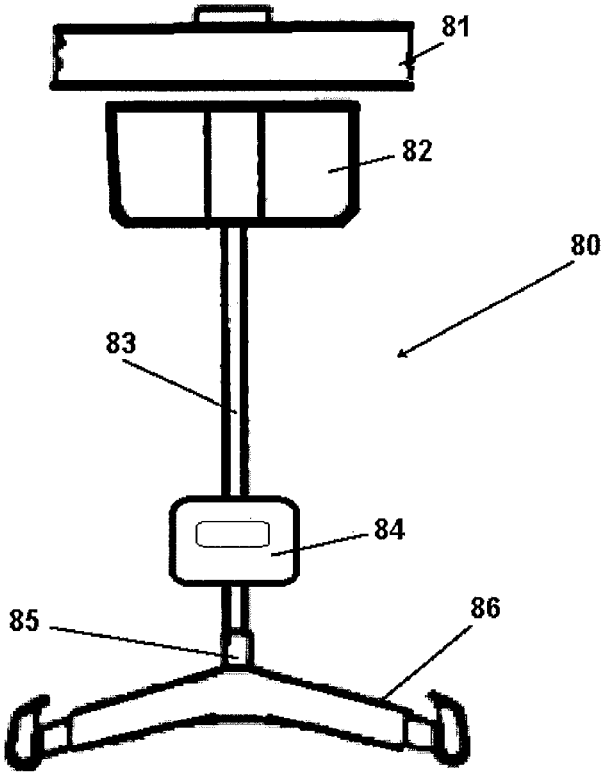
FIG. 8 is a partial view of a fixed ceiling lift with a display.
Figure 9:
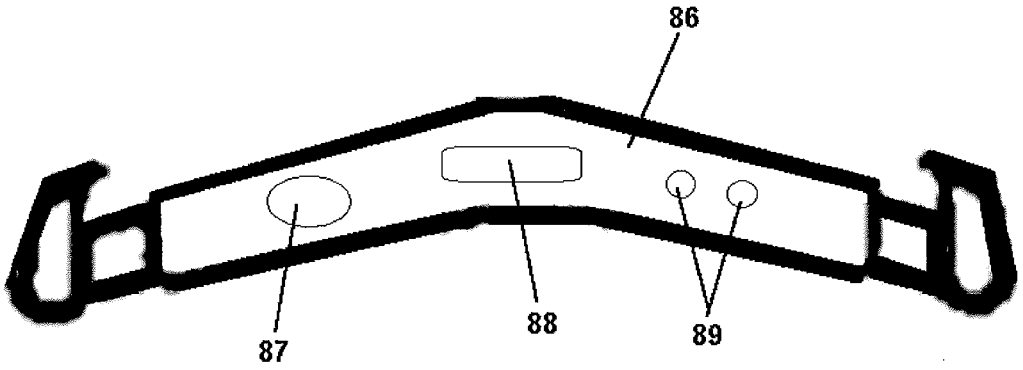
FIG. 9 shows a spreader bar having displays.

The lift assembly may include powered components which consumer and/or generate power, and use or generate data, such as visual displays, sound emitting components, sensors, controls and the like. In one illustrative example, a lifting bar or mounting block may include one or more load cells for, by way of example, monitoring a patient's weight distribution in the patient support, a visual display indicating the patient's weight and overall weight distribution, an alarm indicating unsafe conditions, an emergency stop which halts the upward or downward movement of the patient support, or which halts lateral movement of the lift on the track. FIGS. 8 and 9 show examples of displays and or controls. FIG. 8 shows a ceiling lift system 80 including track 81, hoist assembly 82, flexible-load supporting member 83, display 84, connector 85, and spreader bar 86. FIG. 9 shows spreader bar 86 with displays 87, 88 and control buttons or knobs 89.

Figure 10:
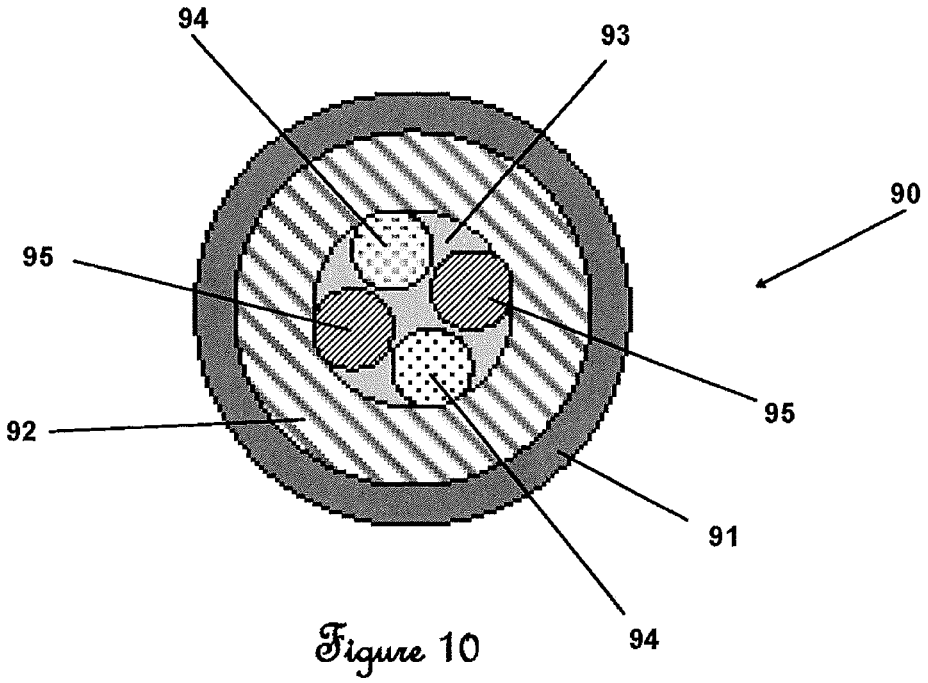
FIG. 10 is a cross-section of an exemplary load-supporting member.
Figure 11:
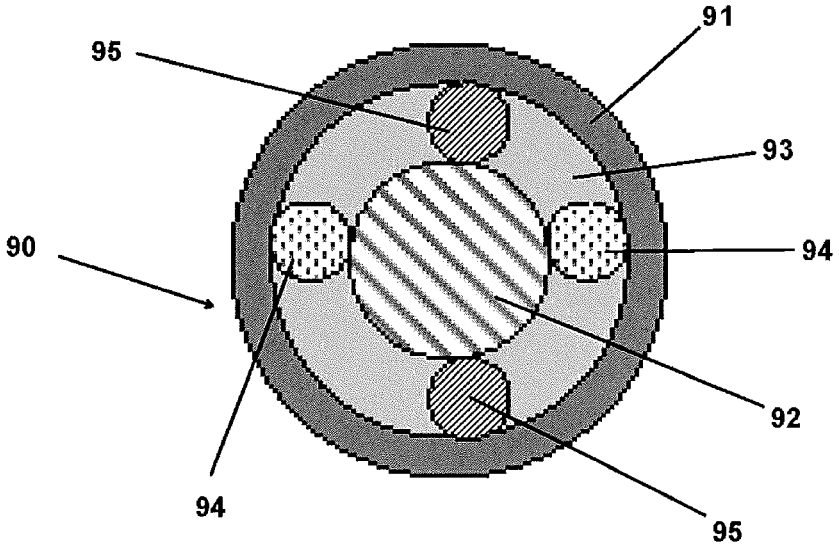
FIG. 11 is a cross-section of another exemplary load-supporting member.

FIGS. 10-13 shown exemplary arrangements for the flexible-load supporting member in transverse cross-section. In the first example, a flexible load-supporting member comprises a woven or webbed material having conductors which are not isolated from each other. In this example, the entire webbing has a protective cover. In the second example, the conductors themselves are individually isolated with a protective jacket. FIG. 10 shows a cross section of a flexible-load supporting member of the present invention. As shown, the flexible-load supporting member 90 includes an outer protective layer 91, load bearing layer 92, power and signal conductor layer 93 including data or signal conductors 94 (and potentially including load-bearing material and/or insulative material), and electrical power conductors 95. FIG. 11 shows another arrangement in cross-section of a flexible-load supporting member 90 including an outer protective layer 91, load bearing layer (shown as a core) 92, power and signal conductor layer 93 including data or signal conductors 94 (and potentially including load-bearing material and/or insulative material), and electrical power conductors 95. When informed by the present disclosure, those of skill in the art will appreciate that the load-bearing layer(s) may include one or more of metallic, polymeric, ceramic, and/or other materials providing mechanical load-bearing properties appropriate to the present embodiments.

Figure 12:
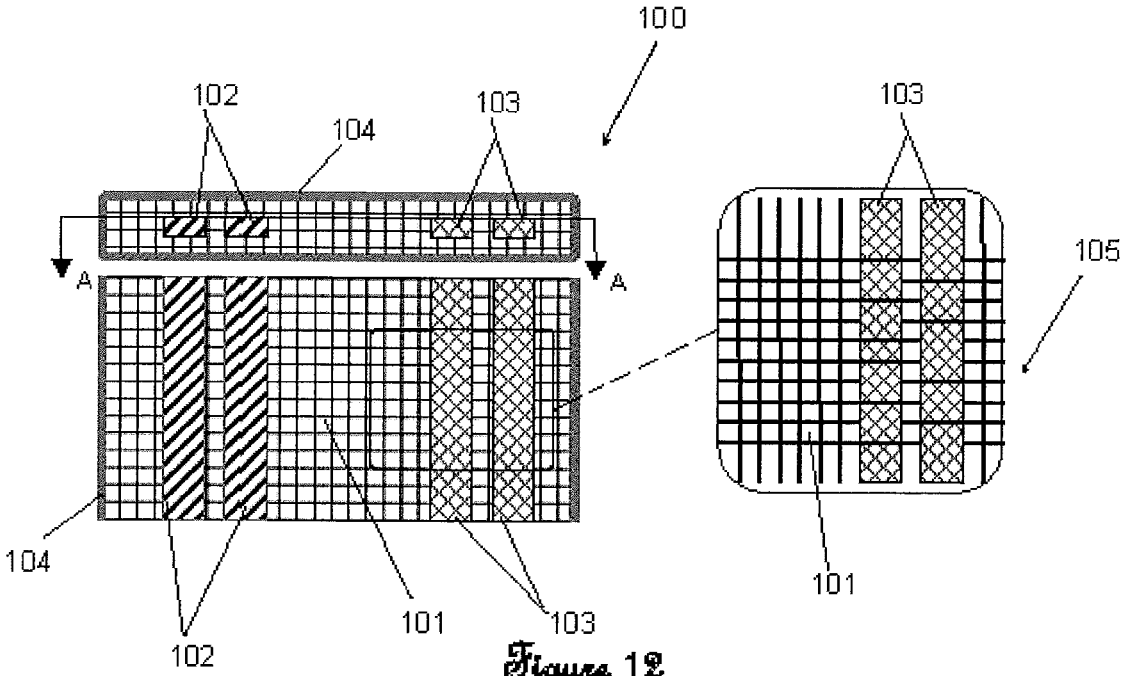
FIG. 12 shows a cross section of an exemplary load-supporting member with non-isolated embedded conductors.
Figure 13:
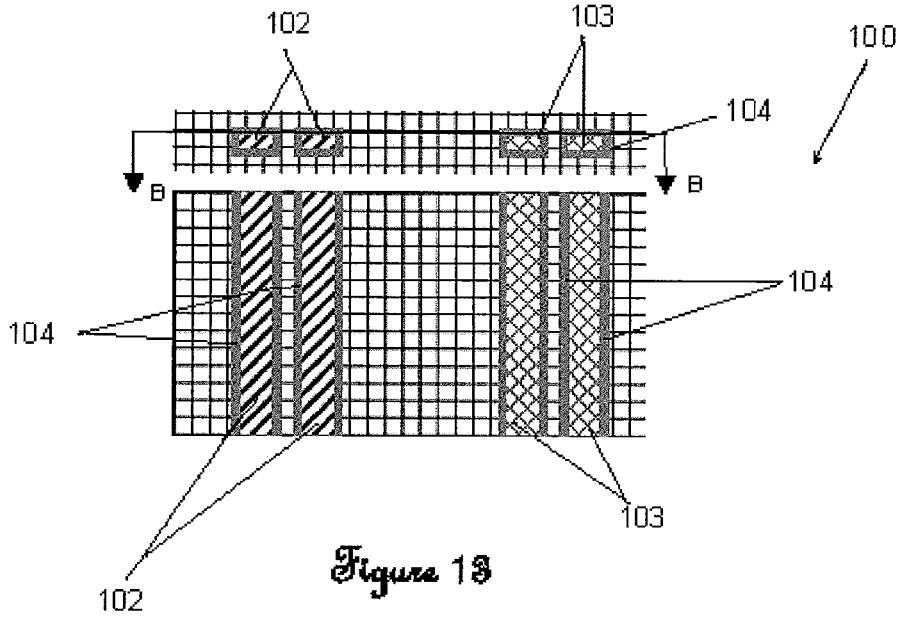
FIG. 13 shows a cross-section of an exemplary load-supporting member with isolated embedded conductors.

FIGS. 12 and 13 illustrate other examples of a flexible load-supporting member with embedded electrical conductors. FIG. 12 shows, respectively, transverse and longitudinal cross section views of a flexible load-supporting member with non-isolated embedded conductors (the longitudinal section view taken along line A-A of the transverse section shown at the top-left of FIG. 12). Flexible load-supporting member 100 includes load bearing material 101 that is non-conductive, electrical conductors (transmitting power) 102, electrical conductors (transmitting signal) 103, and protective jacket 104. The enlarged section 105 shows an example of two electrical conductors 103 embedded in a weave in the longitudinal section view. FIG. 13 shows, respectively, transverse and longitudinal cross section views of a flexible load-supporting member with isolated embedded conductors (the longitudinal section view taken along line B-B of the transverse section shown at the top of FIG. 13). As shown, flexible load-supporting member 100, includes load bearing material 101 that is non-conductive, electrical conductors (transmitting power) 102, electrical conductors (transmitting signal) 103, and protective jackets 104 isolating the conductors.

Figure 14:
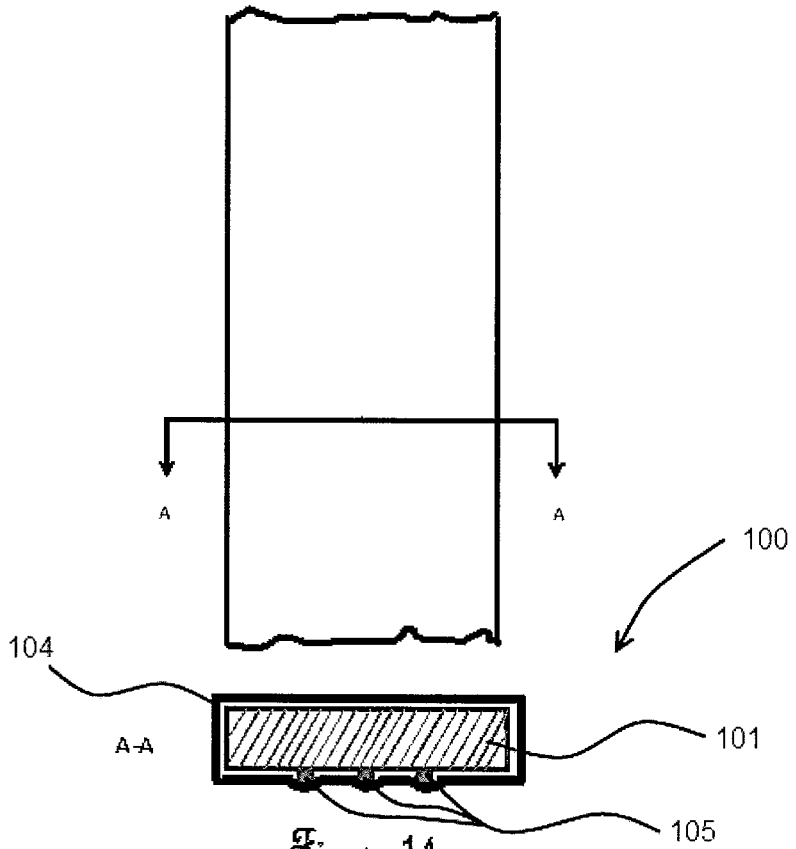
FIG. 14 shows a cross-section of another exemplary load-supporting member with embedded conductors.

FIG. 14 shows a cross-section of another exemplary load-supporting member with embedded conductors taken along line A-A. In this arrangement, the flexible load-supporting member 100 includes load bearing material 101, and electrical conductors 105, which may be include either or both power transmitting conductors or signal transmitting conductors. As shown, the conductors 105 lie adjacent the load bearing material 101 and both are encapsulated or enclosed in protective jacket 104.

With each of the exemplified flexible load-supporting members, the load bearing component and the power and data/signal components run the entire length of the flexible load-supporting member such that power and data may be transmitted from one end to the other.

The integrated flexible load-supporting member hence supports the load of the patient while moving the patient vertically as it is coiled (wound) or uncoiled (unwound) from, for example, a drum 71. The integrated flexible load-supporting member further transmits power and data to and from the various components. In the case of a fixed ceiling lift, the integrated flexible load-supporting member may transmit power to the spreader bar, accessories or motion control means that requires power to operate. The integrated flexible load-supporting member also may transmit data to be displayed to the user on a display integrated to the spreader bar or near it (as shown in FIGS. 8 and 9). The integrated flexible load-supporting member also may transmit data to and from spreader bar accessories, such as a load cell. Further, the integrated flexible load-supporting member may transmit commands to the motor unit from a motion control device connected to the spreader bar and operated by the user. In the case of a portable ceiling lift, the integrated flexible load-supporting member may transmit power and/or data from a load cell inserted between the end of the integrated flexible load-supporting member and a portable ceiling lift trolley or the hoist assembly of the portable ceiling lift. The integrated flexible load-supporting member hence provides power and/or data to the various components of the ceiling lift system without the need for multiple wires and time consuming cable management.

As set forth above, an example of how the track may transmit power or data to a trolley is described in United States Publication No. 2011/0000015, which is incorporated in its entirety herein. In one example, the track may have opposing spaced track sides, where each track side bears a track conductor, as described in paragraphs [0005-0010] and shown in at least FIGS. 1-3 of United States Publication No. 2011/0000015, which are incorporated by reference herein. As described at paragraphs [0005]-[0006] and shown with reference to its FIGS. 1-3 (and using the reference numerals referred to therein), the track conductor 116 is intended to communicate power to the hoist 102 to enable actuation of its lifting member 104. At least a portion of the hoist trolley 106 rides between the track sides 110, with wheels, pinions, or other drive members allowing the hoist trolley to roll or be driven along the track. The hoist trolley bears trolley contacts 118, which are in electrical communication with the hoist 102, that are biased outwardly from the hoist trolley 106 into contact with the track conductors 116. In this manner, electricity borne by the track conductors is communicated to the trolley contacts and in turn to the hoist. As a result, electrical power borne by the track conductors is communicated to the trolley contacts and in turn to the hoist.

As described in paragraph [0006] of United States Publication No. 2011/0000015, the hoist trolley 106 has opposing right and left trolley sides 120 (with only the right side being visible in FIG. 1), and a contact carrier channel 122 (best seen in FIG. 2, provided on an insert 124 received within the hoist trolley 106) extends between the right and left trolley sides 120. A contact carrier 126 is fit within the contact carrier channel 122, and the contact carrier 126 includes the trolley contacts 118 (FIG. 3) thereon so that the trolley contacts 118 extend outwardly from the opposing sides of the contact carrier 126. The contact carrier 125 is movable within the contact carrier channel 122 so mat it may move in at least one dimension with respect to the hoist trolley 106 and hoist 102, namely, in the lateral (rightward/leftward) direction. Preferably, the contact carrier channel 122 is dimensioned such that its bounds (inner perimeter) are at least slightly greater than the bounds (outer perimeter) of the contact carrier 126, so that the contact carrier 126 may also move at least vertically within the hoist trolley 106. When the hoist trolley 106 is installed to ride on the track 108 (see particularly FIG. 3), the contact carrier 126 is situated between the track sides 110 with the trolley contacts 118 extending into contact with the track conductors 116. The trolley contacts 118 are in conductive communication with contact connectors 128, which can in turn be connected to hoist connectors 130 (see FIG. 1) which communicate power to the hoist 102. Thus, power supplied to the track conductors 116 (see FIG. 3) is in turn communicated to the trolley contacts 118, and then in turn to the contact connectors 128, the hoist connectors 130 (FIG. 1), and the hoist 102, whereby a hoist 102 riding along the track 108 may receive power at various locations along the track 108. The contact carrier 126, which is only restrained to the hoist trolley 106 and hoist 102 by the inner bounds of the contact carrier channel 122 (and by the flexible connection between the contact connectors 128 and hoist connectors 130, see FIG. 1), is therefore urged along the track sides lift by the hoist trolley 106, but is displaceable with respect to the hoist trolley 106 as the hoist trolley 106 rides between the track sides 110 so that the trolley contacts 118 may always remain in conductive communication with the track conductors 116. This conductive communication is also assisted by biasing the trolley contacts 118 elastically outwardly from the contact carrier 126 sides, as by the springs 132 shown in FIGS. 2 and 3, so that the trolley contacts 118 remain in contact with the track conductors 116. Because the contact carrier 126 displaces between the track sides 110 to follow their contours (and since the trolley contacts 118 are elastically biased into contact with the track conductors 116), the contact problems that may arise as the hoist trolley 106 and hoist 102 travel about the track 108 are at least substantially avoided.

Those of skill in the art will appreciate that embodiments not expressly illustrated herein may be practiced within the scope of the claims, including that features described herein for different embodiments may be combined with each other and/or with currently-known or future-developed technologies while remaining within the scope of the claims. Those of skill in the art will also be enabled to practice various other embodiments of load-bearing structures with patient lifts from the embodiments disclosed herein. Although specific terms are employed herein, they are used in a generic and descriptive sense only and not for purposes of limitation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment.

The invention claimed is:

1. A lift system comprising:

a track trolley configured to ride along at least one elongated track and configured to receive power and/or data communications via the at least one track;

a hoist assembly in electrical communication with the track trolley and including a winding unit;

a lift assembly disposed below the hoist assembly configured to connect to a patient support and in electrical communication with hoist assembly;

an elongate flexible load-supporting member attached to the winding unit and in electrical communication with the hoist assembly and the lift assembly;

wherein the flexible load-supporting member comprises at least one load bearing component, and at least one of a power transmission component and a data transmission component that transmits power and/or data along a length of the flexible load-supporting member.

2. The lift system of claim 1 wherein the hoist assembly is attached to the track trolley, and the flexible load-supporting member is disposed between the hoist assembly and the lift assembly.

3. The lift system of claim 1 wherein the flexible load-supporting member is attached to the track trolley and is disposed between the track trolley and the hoist assembly.

4. The lift system of claim 1 wherein the flexible load-supporting member is releasably attached to at least one of the track trolley, the hoist assembly, and the lift assembly.

5. The lift system of claim 1 wherein the flexible load-supporting member comprises a cable having a protective outer layer, an inner layer of the load bearing component, and an inner layer of at least one of the power transmission component and a data transmission component.

6. The lift system of claim 5 wherein the flexible load-supporting member comprises an inner layer of the power transmission component and an inner layer of the data transmission component.

7. The lift system of claim 1 wherein the flexible load-supporting member comprises a strap wherein the load bearing component and the at least one of an electrical conductor configured to transmit power and an electrical conductor configured to transmit data are disposed within a protective jacket.

8. The lift system of claim 7 wherein the strap comprises a mesh and the at least one electrical conductor is embedded into the mesh.

9. The lift system of claim 1 wherein the flexible load-supporting member comprises a strap wherein the at least one of an electrical conductor configured to transmit power and an electrical conductor configured to transmit data are disposed within a protective jacket and isolated from the load-bearing component.

10. A ceiling lift system comprising:

at least one ceiling mounted track;

a track trolley attached to and configured to ride along at least one elongated track and configured to receive power and/or data communications from the at least one track;

a hoist assembly in electrical communication with the track trolley;

a lift assembly disposed below the hoist assembly configured to connect to a patient support and in electrical communication with hoist assembly;

an elongate retractable load-supporting member attached to the hoist assembly and in electrical communication with the hoist assembly and the lift assembly;

wherein the retractable load-supporting member integrally comprises at least one load bearing component, and at least one of a data transmission line positioned along a lengthwise portion of the retractable load-supporting member and a power transmission component.

11. The ceiling lift system of claim 10 wherein the hoist assembly is attached to the track trolley, and the retractable load-supporting member is disposed between the hoist assembly and the lift assembly.

12. The ceiling lift system of claim 10 wherein the retractable load-supporting member is attached to the track trolley and is disposed between the track trolley and the hoist assembly.

13. The ceiling lift system of claim 10 wherein the retractable load-supporting member comprises a cable having a protective outer layer and an inner conductor layer, and wherein the load bearing component, and the at least one of the power transmission component and data transmission component are disposed within the protective layer, and the at least one of the power transmission component and data transmission component are disposed within the conductor layer.

14. The lift system of claim 10 wherein the retractable load-supporting member comprises a strap comprising at least one strand of the load bearing component, at least one strand of the power transmission component, at least one strand of the data transmission component, and a protective jacket.

15. A portable patient lift system comprising:

a hoist assembly configured to receive power and/or data;

a lift assembly disposed below the hoist assembly configured to connect to a patient support and in electrical communication with hoist assembly;

an elongate retractable load-supporting member attached to the hoist assembly and in electrical communication with the hoist assembly and the lift assembly;

wherein the flexible load-supporting member integrally comprises at least one load bearing component, at least one electrical conductor configured to transmit power, and at least one electrical conductor configured to transmit data.

16. The patient lift system of claim 15 wherein the flexible load-supporting member comprises an electrical connector at one end.

17. The patient lift system of claim 16 wherein the flexible load-supporting member comprises an electrical connector at each end.

18. The patient lift system of claim 16 wherein the flexible load-supporting member is releasably attached to the hoist assembly.

19. The patient lift system of claim 17 wherein the flexible load-supporting member comprises a strap wherein the strap comprises at least one strand of the load bearing component, at least one strand of the at least one electrical conductor configured to transmit data, at least one strand of the electrical conductor configured to transmit power, at least one protective jacket about the strands of the electrical conductors.

* * * * *